US012060687B2

(12) United States Patent
Aittaniemi

(10) Patent No.: US 12,060,687 B2
(45) Date of Patent: Aug. 13, 2024

(54) FLOATING RIVER

(71) Applicant: KALASYDÄN OY, Rovaniemi (FI)

(72) Inventor: Tarmo Aittaniemi, Rovaniemi (FI)

(73) Assignee: KALASYDÄN OY, Rovaniemi (FI)

( * ) Notice: Subject to any disclaimer, the term of this patent is extended or adjusted under 35 U.S.C. 154(b) by 0 days.

(21) Appl. No.: 17/993,540

(22) Filed: Nov. 23, 2022

(65) Prior Publication Data

US 2024/0167238 A1 May 23, 2024

(30) Foreign Application Priority Data

Feb. 2, 2022 (FI) ..... 20220008
Jul. 29, 2022 (FI) ..... 20220051

(51) Int. Cl.
*E02B 8/08* (2006.01)

(52) U.S. Cl.
CPC ..... *E02B 8/085* (2013.01); *E02B 8/08* (2013.01)

(58) Field of Classification Search
CPC ..... E02B 8/08; E02B 8/085
USPC ..... 405/81–83, 60, 63, 64; 119/219
See application file for complete search history.

(56) References Cited

U.S. PATENT DOCUMENTS 3,852,965 A * 12/1974 Rudd ..... E02B 15/0814 405/72
4,096,700 A * 6/1978 Muramatsu ..... E02B 15/06 405/63
4,136,994 A * 1/1979 Fuller ..... F03B 13/188 405/27
4,190,381 A * 2/1980 Knaus ..... E02B 15/0864 405/63
5,161,913 A * 11/1992 Boylan ..... E02B 8/085 405/83
5,707,172 A 1/1998 Wilcox
6,832,578 B2 * 12/2004 Odeh ..... A01K 61/00 405/83
2002/0172560 A1 * 11/2002 Dreyer ..... E02B 15/0814 405/63
2012/0003045 A1 * 1/2012 Singleton ..... E02B 15/085 405/63
2012/0020732 A1 * 1/2012 Stiles ..... E02B 15/06 405/63
2014/0197108 A1 * 7/2014 Stratton ..... E02D 27/50 405/64

(Continued)

FOREIGN PATENT DOCUMENTS

CN 111827201 A 10/2020
CN 212026105 U 11/2020
EP 1852554 A2 * 11/2007

(Continued)

OTHER PUBLICATIONS

International Search Report for PCT/FI2023/050065 dated Jun. 7, 2023, 4 pages.

*Primary Examiner* — Sunil Singh
(74) *Attorney, Agent, or Firm* — NIXON & VANDERHYE

(57) ABSTRACT

Disclosed is a floating river module that has at least one buoy to float also the other parts of the module, the other parts including an at least partly sub-merged vertical wall element being solidly attached to the buoy, the vertical wall element including a horizontal keel element. Also disclosed is a floating river system formed from such modules for guidance of fish.

15 Claims, 8 Drawing Sheets

(56) References Cited

U.S. PATENT DOCUMENTS

Figures 1, 1F, 1G:
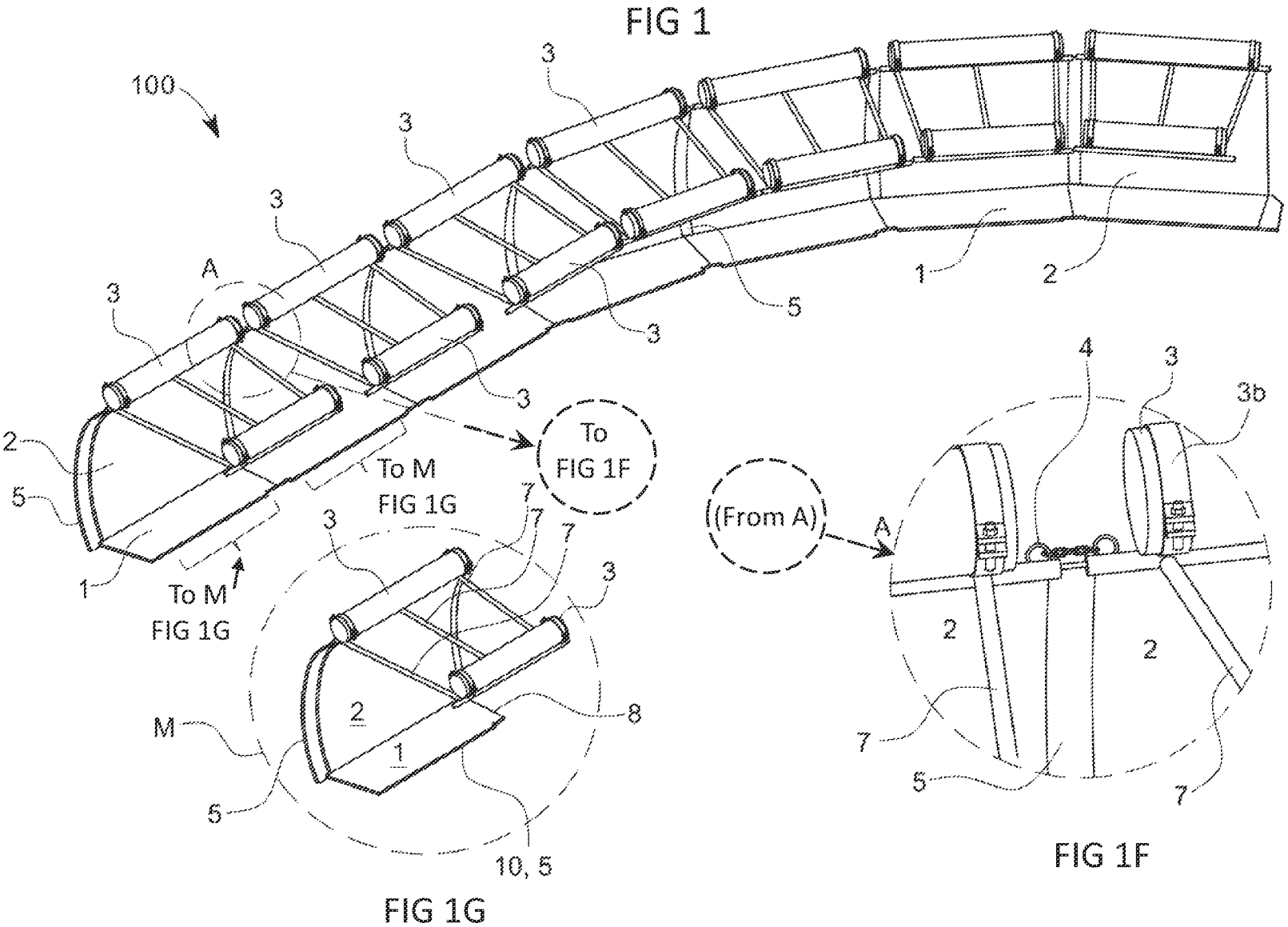

2019/0119874 A1* 4/2019 Aittaniemi ..... E02B 8/085

FOREIGN PATENT DOCUMENTS

| | | | | |
|---|---|---|---|---|
| FR | 3003582 | A1 | * | 9/2014 |
| JP | 02058620 | A | * | 2/1990 |

* cited by examiner

FLOATING RIVER

TECHNICAL FIELD

In a very general level, the present disclosure of embodiments of the invention are pertinent to water system construction as such, but more specifically, making such watercourses of river systems with non-disturbance of the river, in allowing especially migratory fish being guided in their spawn routes even in built-up waters. However, even more specifically, the embodiments of the invention relate to floating river module in accordance with an independent claim preamble, the claim being directed to such a floating river module. The embodiments of the invention relate also to a floating river system using such a floating river module for the implementation of a floating river system made of such embodied floating river modules.

BACKGROUND

The need of human beings to build power plants for the increasing need of energy production, but from the standpoints of utilization of renewable energy sources consequently can also produce direct damage to the nature itself, but additionally to the sources of livelihood, beneficial for the nature.

Migratory fish, for example Salmoniforms, the Anguilliformes, and/or alike, that migrate upstream back to their natal rivers to spawn encounter barriers in such rivers where the riverbed has been built with dams, such to be utilized in the industry of electricity production or in other power plants.

The passage over the power plant is blocked if no passing watercourse has been built. Even if there were such, the path of young migratory fish back downstream can be difficult, especially if the fish have to go through turbine tunnels. The fish may get hurt, and thus exposed to diseases. On the other hand, the passage by fish path passing the turbine tunnel consumes water, as remarkably does a fish ladder, out of which the latter is also quite expensive to build, but also leaves a mark on the landscape which is seldomly considered to add value to the river shore scenery, if ever. Additionally, the fish may get damaged in the shallow pools when jumping from one to another, to yield a high risk of being exposed to the diseases.

On a further other hand, salmoniform fish, for example, are not attracted to going into deep waters, which in its part makes it difficult for young fish to return into the turbine tunnels or passing by tunnels in deep.

However, aforementioned problems related to the passing over dams and similar types of blocking objects have been solved by using migratory fish passage units with the related systems, to provide migratory fish passages that are hydraulic arrangement.

Although the collisions of interests between fish instincts and their nature contrary to the energy production needs can be solved in an extremely economic way, allowing preserving the landscaped and even without essential losses to the functionality or to the electricity production, by using such migratory fish passage units and systems utilizing such, there are situations in which the fish cannot decide straight the route where to go. Especially in such cases if the river as a spawn route has many branches, or there has been made artificial river-bed renovation maneuvers to the original river bed, such as sifting the river course, for example, the fish may get lost and end up to the turbine tunnels, if get lost to the wrong branches. In some cases the young fish for example do not find their way downstream the river.

SUMMARY OF THE DISCLOSURE

It is an object of the disclosure of the embodiments of the invention to mitigate the aforementioned problems. A solution according to the present disclosure of the invention is to provide a floating river by an ensemble of floating river modules in accordance with the embodiments of the present disclosure of the invention that has been characterized in the characterizing part of an independent claim directed to the floating river module.

It is also a synergic object of the present disclosure to form from such embodied floating river modules an embodied ensemble of such as a floating river system that forms a floating river that guides the fish swimming therein in the waters of the system, guiding fish from various waters to a safe route, for example over power plant pools, according to the natural instincts of the fish, so that the power plant operators can make sure for the fish when following their instincts are following a safe return route towards the waters downstream, so that not only the fish but also animal and nature activists can be pleased as well as other users of the river shores.

According to the present disclosure, a module of a floating river, i.e. floating river module, is characterized in that what has been indicated in the claim 1.

A module according to the present disclosure has at least one buoy to float the module and thus also the parts of said module, the parts comprising at least partly sub-merged vertical wall element. According to the embodiment the vertical wall element is solidly attached to said buoy. In addition, said vertical wall element is comprising an attachment means to attach thereto a stabilizer as a horizontal keel element, or alternatively to a separate but attached, a horizontal keel element that is integrated to said wall element.

According to an embodiment variant, such a horizontal keel element can be attached to the vertical wall element at the edge therebetween, or in an alternative embodiment the integrated vertical wall element and the horizontal keel element are forming an angle as they are integrated parts (horizontal and vertical) of the same body. The vertical wall element is used in forming a side wall to the floating river. The horizontal keel element is used in forming a bottom side in suitable part to the floating river, in some embodiments, where the bottom is used for enhanced guidance for the fish. In such an embodiment the angle between the vertical wall element and the horizontal keel element helps to provide the horizontal keel element to provide the horizontal keel element in a horizontal direction in respect to the vertical wall element so that there is a resistance to such flows in the flowing water that tend to pivot the vertical wall element towards horizontal positions. This is important to the floating river as to preserve the form for the guiding function of the floating river to guide the fish in their natural swimming depths, in accordance with the species being guided. According to an embodiment variant, there can be several horizontal keel elements attached to the same vertical wall element, so to provide a guiding passage for different depths swimming species (i.e. Salmoniforms, the Anguilliformes, for example).

According to an embodiment of the disclosure, a horizontal keel element has been embodied in the disclosure to point towards the floating river middle direction, but according to a further variant an additional horizontal keel element can be provided additionally so that it points to an outboard direction from the vertical wall element, although may potentially be restricting the use of the near waters of the floating river at the distance of such an outbound horizontal keel element at the depth.

The module of a floating river, the floating river module, according to an embodiment of the present disclosure has two distinguished buoys to float the module and said parts of said same module. According to the variant at least one of the buoys can be connected to the module by supports, so that the supports are at a distance from the other buoy, so providing further support to the vertical wall element to hold its average position with the help of the horizontal keel element.

According to an embodiment a buoy can be positioned to the inside side of the floating river water passage, at a distance by the support similarly as an inboard catamaran body. Alternatively or in addition to such position of the other buoy, such can be attached to the outside side of the floating river water passage, by a similar to said support at a distance, as an outboard catamaran body. This way the vertical wall element position can be enhanced secured sufficiently to vertical position, in various conditions, especially by using inboard and outboard positioned buoys, although may take more width reserved for the floating river.

The floating river module of a floating river according to an embodiment of the present disclosure has such a vertical wall element that comprises an edge formation to attach it to another similar floating river module into a train position straight or by an intermediate connecting member. The edge can be formed to match to the following floating river module straight or alternatively via a connecting member with the formations to fit to both floating river modules to be joined by said floating river modules. Using connecting members as connectors, the embodiment has the advantage that if the connection formation part is somehow broken, there is not necessarily a need to replace the whole module. In addition, the vertical wall elements can be symmetric in respect to the edges, which makes the manufacturing potentially simpler and more economic.

The module of a floating river according to an embodiment of the present disclosure has in said horizontal keel element an edge formation to attach to another similar module in a mirroring position by an intermediate connecting member between the horizontal keel elements. Alternatively, the horizontal keel element has the attaching formation integrated into the edge as such for straight attach to a neighboring horizontal keel element of the neighboring floating river module in a floating river system. Similar manner as for attaching vertical wall elements to the next ones, also horizontal keel elements can have similar embodiments to attach the horizontal keel elements to the next ones.

In an alternative embodiment the module of a floating river according to an embodiment of the present disclosure has passages for waters through said vertical wall element and/or said horizontal keel element, passages for waters in communication between the inboard and outboard waters, in which the floating river is intended to float, by the modules and the buoys thereon, as in use.

According to an embodiment of the disclosure the floating river module is a cross sectional half profile module, forming so a half-cross-sectional element of said floating river channel. However, a skilled person in the art knows from the embodiments that mirroring position mount modules need not necessarily to have same dimensions in respect of the horizontal keel element. However, tapering special modules can be used in adjusting the width changes of the embodied floating river.

According to an embodiment of the disclosure the floating river module is having said vertical wall element curved in the direction of the floating river flow channel.

According to an embodiment variant, the floating river module has at the upstream and/or downstream ends attaching formation to provide the curvature to the floating river, the curvature being formed by the connections of an ensemble of such modules, which do not necessarily be curved themselves. According to an embodiment variant, the floating river modules can have certain kind of hinges so to provide the curvature to the system formed from the floating river modules embodied. According to a further embodiment the hinges can be lockable to a certain position by locking means. According to an embodiment such locking means can be embodied by suitable sized agricultural cotters.

According to the present disclosure, a floating river as a floating river system composed of an ensemble of floating river modules as connected to each other. According to an embodiment variant the connections can be made by connecting members, i.e. connectors, so that when connected the floating river modules form a sub-merged flow channel being fenced into the water on whose surface the floating river modules float for formation of the floating river as a floating river (module) system.

According to an embodiment of the disclosure in the floating river system buoys and/or said sub-merged vertical wall element have quick-lock parts to quick-lock them to each other in a solid manner, but also in a detachable manner for service.

According to an embodiment of the disclosure in the floating river system the wall element and the horizontal keel element have a quick-lock parts to quick-lock to each other. Alternatively, the wall element and the horizontal keel element are formed in the manufacturing by twisting a plate to two parts having an angle therebetween these so formed sides for horizontal and vertical parts/sides. At the joint there can be a roundish formation in an embodiment variant, in such a case as sharp edge is not made. In a further variant the integration of the wall element and the horizontal keel element has been made by welding, gluing, and/or by screws and bolts.

According to an embodiment, the floating river system can be provided by counting means, so that the operators of the system can count the fish swimming in the floating river. According to an embodiment such counting means can have at least the counting sensors at a specific floating river module. According to a variant of the embodiment, such a counting means can comprise camera for the counting of the fish by the camera or an ensemble of such configured to take photos and/or video. The photos and/or video can be recorded at the camera on site, but can be transmitted to a special remote site, for further processing, via information network to which the camera has an access via functional connection.

According to a further embodiment variant the counting means, operating as a counter, can have a sensor (i.e. a camera) to recognize the fish in the floating river. Such sensor can comprise suitable camera or an ensemble of such, suitable to close range photogrammetry, so that the size and/or the type of the objects can be recognized. This has importance in classifying the fish according to their size and/or species, when studying the fish population and/or the development of such.

Alternatively or in addition, machine vision and/or photogrammetry by suitable cameras/sensors that provide the data for the visual analysis of the objects in the floating river can be used, when these means are mounted to a special floating river module in the floating river. Especially close-range photogrammetry can be used in collection of photographs from a lesser distance than traditional aerial (or orbital) photogrammetry. According to an embodiment, the photogrammetric analysis may be applied to an ensemble of photographs taken by a high-speed photography by a camera in a special floating river module, to estimate with improved accuracy the fish being photographed/video filmed. According to an embodiment the image analysis as such can be made on site located computer, but according to a variant of an embodiment in a remote site, which can be anywhere at the reach of an information networks, such as Internet, for example.

According to an embodiment variant the object recognition is made by a LIDAR-system (Light detection and ranging—LIDAR) as such, as being assembled to one of the floating river modules, for the data acquisition in suitable part. Accordingly, oil emissions for example can be detected by such a special floating river module provided with the LIDAR-system.

According to a further embodiment, the photogrammetry means, such as cameras are connected to a transceiver at a specific floating river module, so that an outsider remote operator can have photos and/or video about the fish swimming in the floating river waters, by using in the connection an information network, such as cellular network, IOT-network, wi-fi and/or Internet. According to an embodiment the floating river system comprises a microprocessor/computer for the communication from the floating river system, from a specific floating river module to a remote operator, but according to an embodiment variant also two-direction communication to control the camera and/or counting means of the floating river module in question.

The counting means as a counter is thus a smart counter, being controllable in respect of determination of the size and type of the swimming fish, and accordingly to provide classification to fish according to the size and species estimation.

The counter can be implemented in suitable part by suitable hardware and software, as a skilled person understands from the embodiments, provided that the hardware is waterproof by the required parts. Although the counter could be an opto-electro-mechanical simple on-site counter as such applied into one embodiment, it is also possible to do the effective counting remotely in a remote site connected to the information network with an embodied floating river system via the specific floating river module with a camera. Accordingly the remote site so connected can be effectively anywhere by the access via the information networks in use.

According to an embodiment, the floating river system has in one or some modules of it Radio telemetry antenna to be used in fish recognition, by the tags that tagged fish carry (for example PIT TAG). such tagging can be used in marking certain fish for the following the fish migration. The radio telemetry reading can be used in a module of the floating river system. Also as adapted to provide an interrogation signal to which a tag (attached to the fish) passing by would respond, and consequently the reader can provide the tag ID and the data contained by the tag as read to the floating river system, and via the network connections even to remote sites, where the ID can be associated to the database. According to the imaging data (LIDAR, photos, video, photogrammetry) about the fish passing by, the size and species can be identified by the camera, and thus associated to the read PIT TAG, to update the database.

According to an embodiment variant the floating river system can have controllable port in the control of the counting means (counter), so that in an embodiment variant to the counter associated/attached photogrammetry and/or LIDAR means can control the port opening and closing, to guide fish to separate routes, or from various routes being guided to the floating river main channel.

In an embodiment variant, the floating river can have collecting branches that collect fish towards the floating river channel as a main channel. At the joint to the main floating river channel there can be a port, which can guide the fish to the main floating river. According to an embodiment such a port can be one port of an ensemble of ports that are arranged to block passage of fish of certain species and/or size.

Wording "to comprise" has been used as an open expression.

SHORT DESCRIPTION OF THE DRAWINGS

Next, embodiments according to the present disclosure of the invention are described in more detail with reference to the appended drawings illustrating exemplary embodiments of the disclosure, in which the word "exemplary" is used herein to mean "serving as an example, instance, or illustration." Any embodiment described herein as "exemplary" is not necessarily to be construed as preferred or advantageous over other embodiments.

Figure 1A:
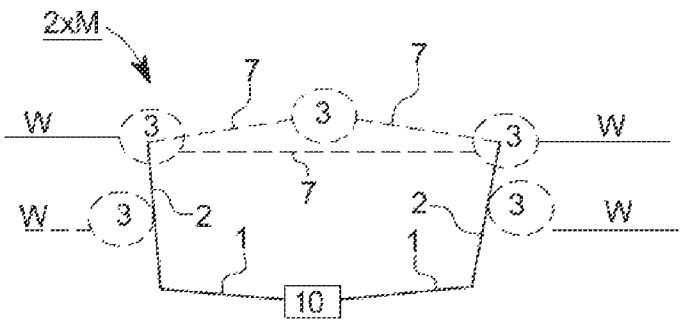
Figure 1D:
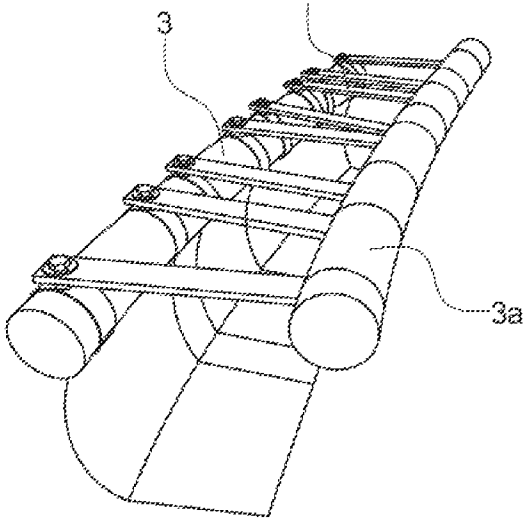
Figure 1I:
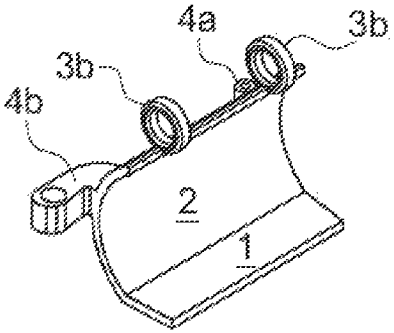
Figure 1H:
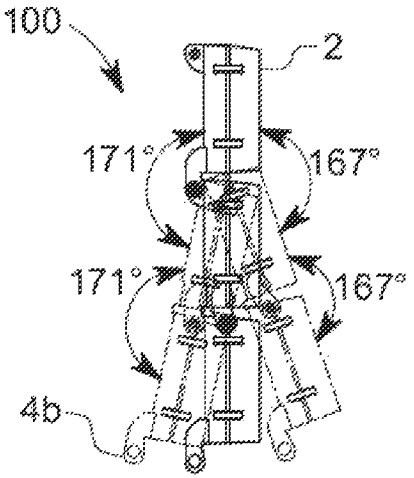
Figure 1B:
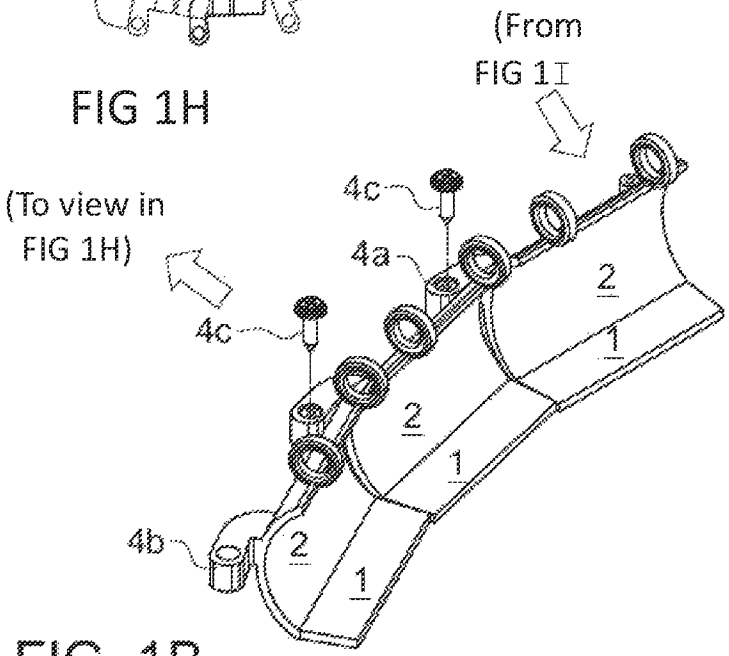
Figure 1E:
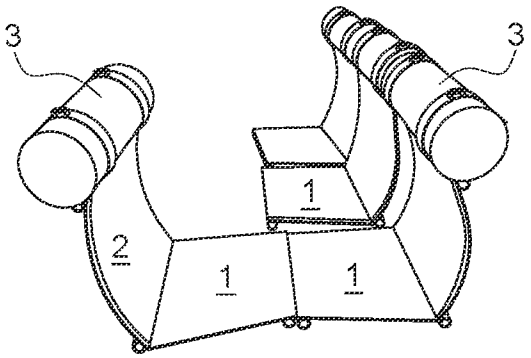
Figure 1C:
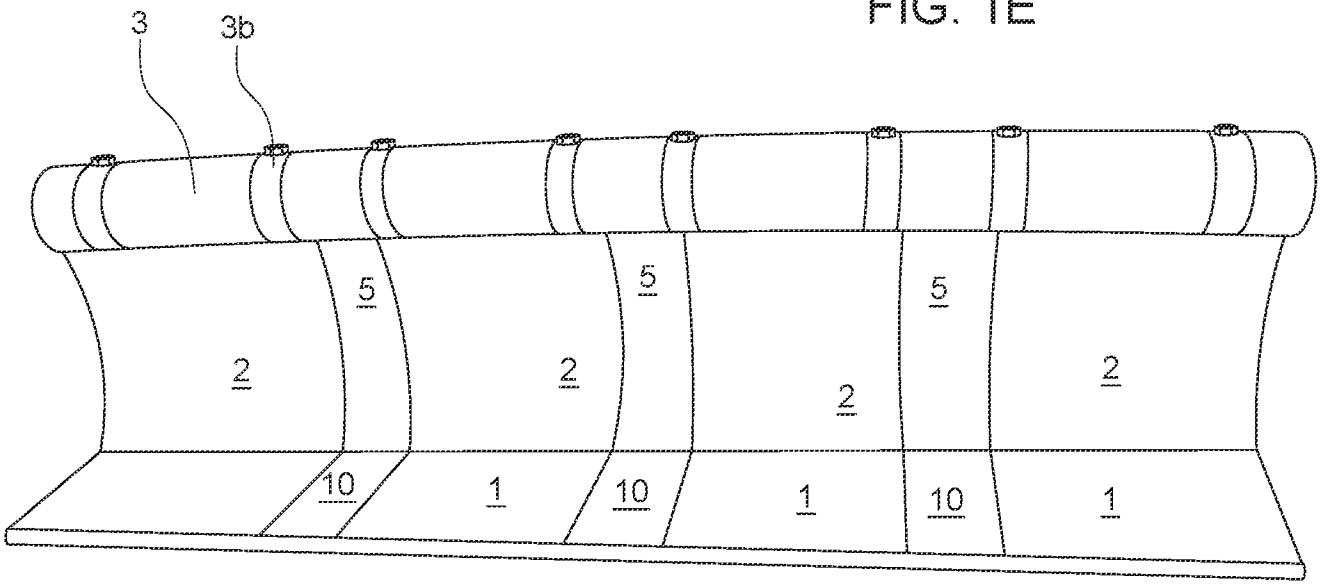
Figure 2:
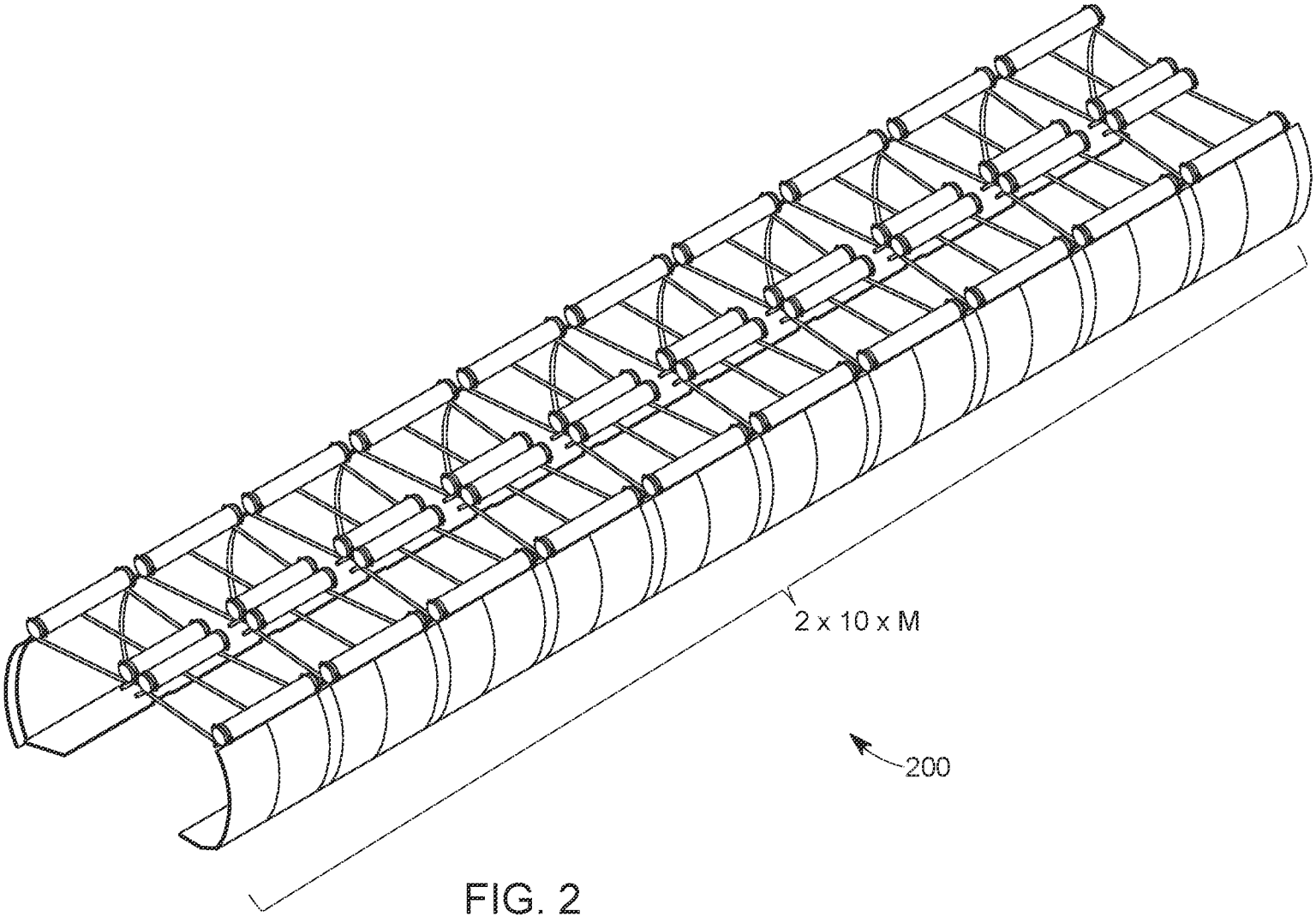
Figure 3:
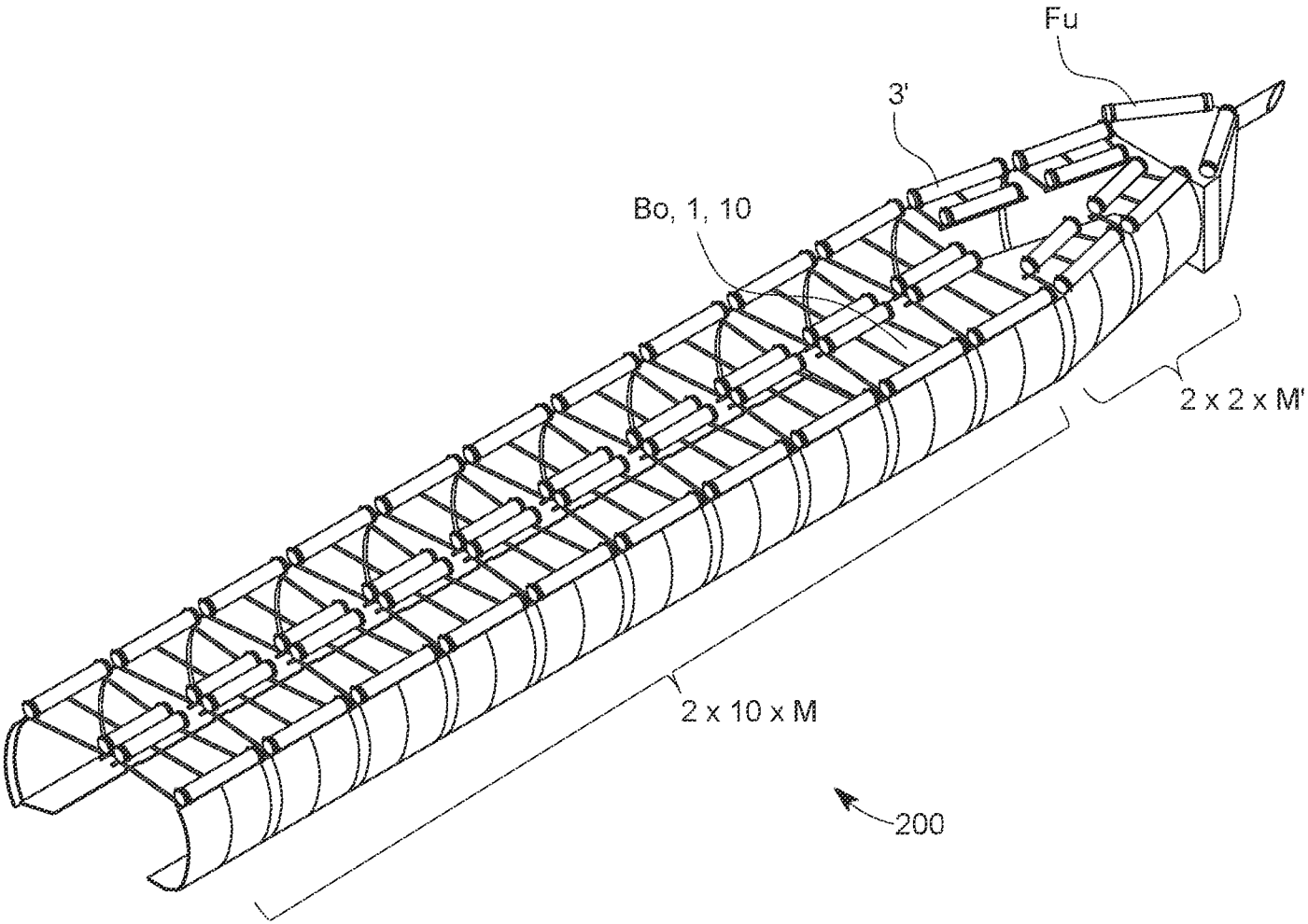

FIG. 1 illustrates an example of an embodiment according to the present disclosure, a floating river element embodied as well as an ensemble of floating river elements forming a floating river system as a side element part of such a floating river, where FIGS. 1F and 1G illustrate details of an embodiment in FIG. 1, FIG. 1A illustrates an example of a profile of a floating river system, via floating river modules in a mirror geometry with alternative locations of buoys in respect to the floating river module and the water level, FIG. 1B illustrates an embodiment example according to the present disclosure, connecting embodied floating river modules into train position, at one side of the floating river system, by connecting means, into embodied angles in respect to each other, where FIG. 1H illustrates a view to an embodiment example in FIG. 1B and FIG. 1I illustrates a view of an embodiment detail in FIG. 1B, FIG. 1C illustrates an example of attaching embodied floating river modules to each other, FIG. 1D illustrates an example of attached floating river modules with buoys according to an embodiment of the present disclosure, FIG. 1E illustrates an example of a mirror geometry of floating river modules to provide a closed bottom of the floating river system, FIG. 2 illustrates an example of a part of a floating river, as embodied a floating river system, composed of embodied floating river modules, leaving the bottom of the floating river open according to open bottom embodiment as an alternative to closed bottom embodiment in FIG. 1E illustration, FIG. 3 illustrates an example of a part of a floating river, as embodied a floating river system, composed of embodied floating river modules with such embodied modules that as put together form a tapering flow channel, leaving the bottom of the floating river open according to open bottom embodiment at one part of the floating river as an alternative to closed bottom embodiment in FIG. 1E illustration, but having a closed bottom part at the tapering part of the floating river.

Figures 4, 5:
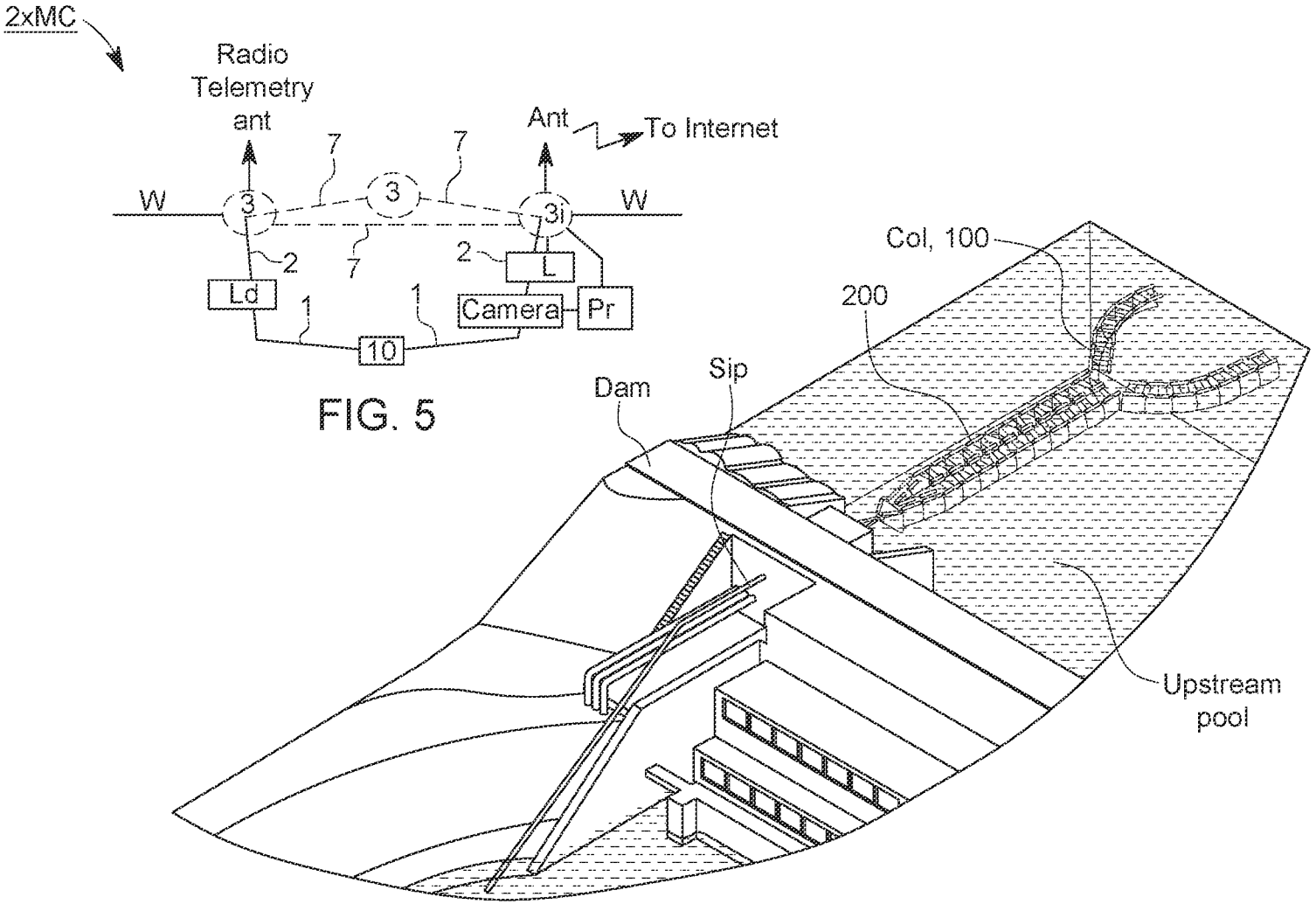
Figure 6B:
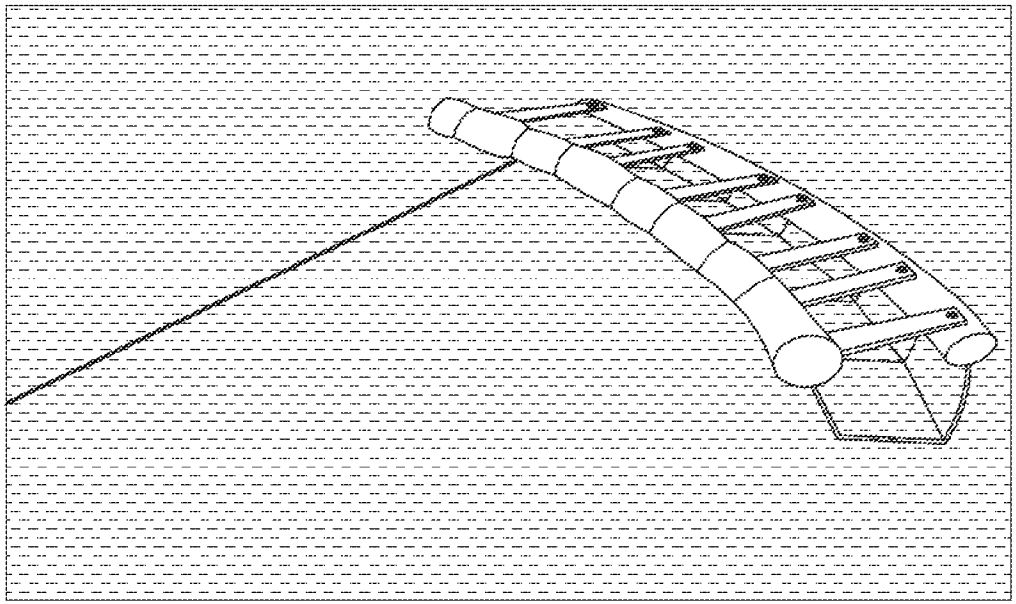
Figure 6A:
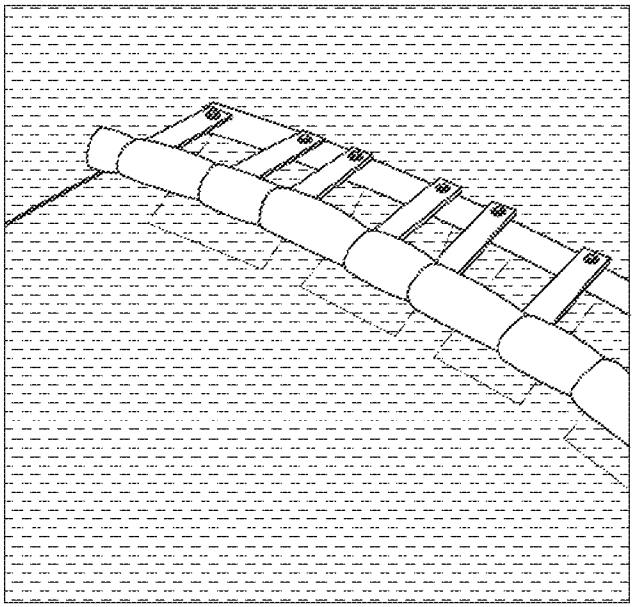
Figure 7:
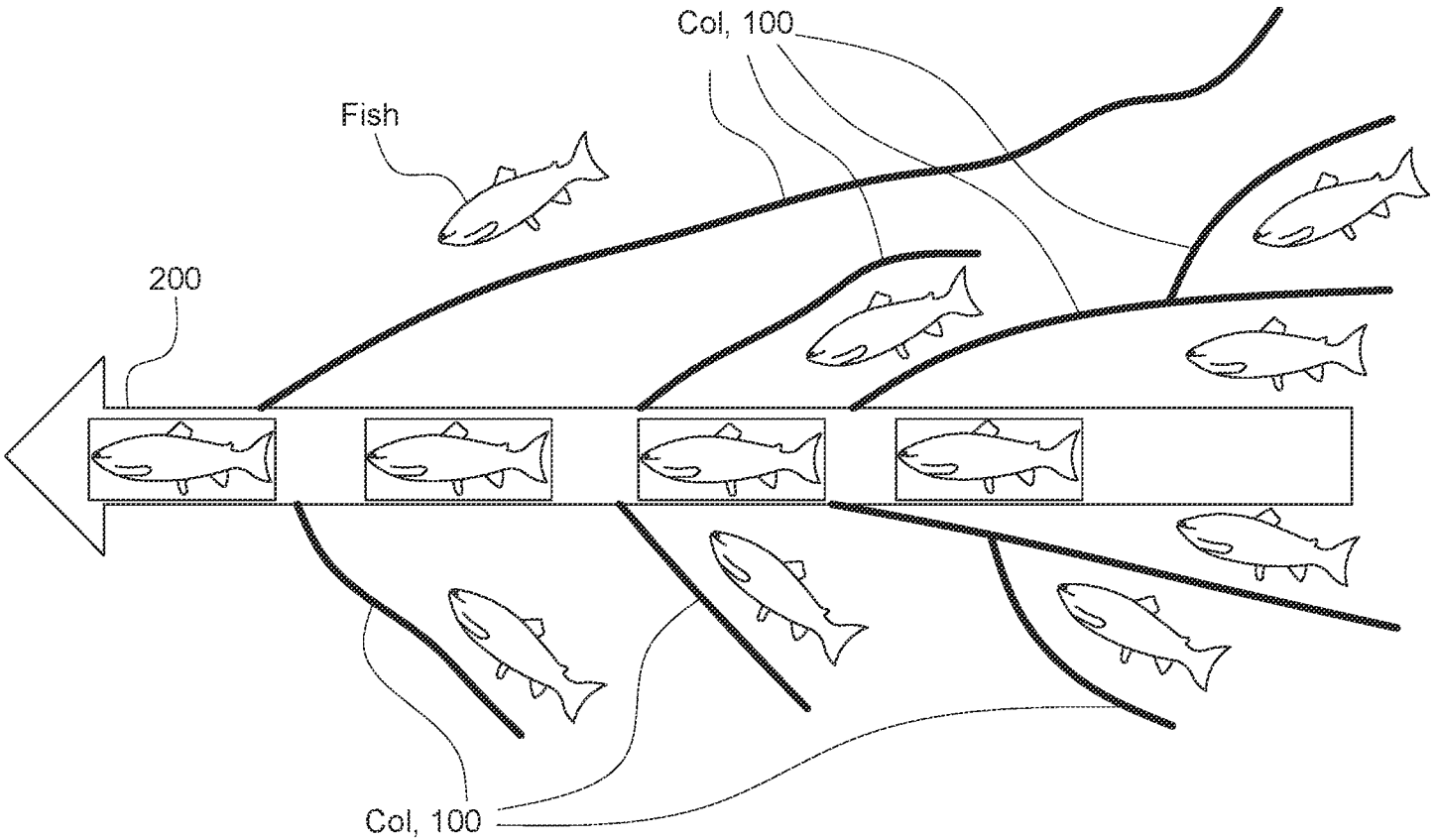

FIG. 4 illustrates an example of a floating river floating on a dam pool in use, with collection fork to guide fish into the floating river system, for further guidance through/bypass the dam, FIG. 5 is illustrating an example of counting means as a part of a special floating river module embodiment, FIG. 6A and FIG. 6B illustrate an example of a demonstration of a floating river in a river being controlled in the flow, and FIG. 7 illustrates an example of a floating river with an ensemble of collecting branches.

DETAILED DESCRIPTION OF EMBODIMENTS OF THE PRESENT DISCLOSURE

The above descriptions are for purposes of illustration and are not meant to be limiting. Numerous other examples, configurations, processes, etc., may exist, some of which are described in greater detail below. Example embodiments will now be described with reference to the accompanying figures In the following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments.

In the following, same reference numbers are used in different figures, if not otherwise expressly indicated. However, objects with the same reference numbers need not to be exactly the same in shape, size and/or composition, as a skilled person in the art by his/her education knows from the context of the disclosure part in question.

FIG. 1 illustrates a module M as a member of an ensemble of such of a floating river system part in an arc 100 form, being composed of such floating river modules (M) in the illustrated example of an embodiment. The arc 100 can be used in forming one board or side of a floating river as a part of a floating river system. A skilled person in the art understands, that although concave form has been shown, a corresponding but convex arc can be formed accordingly, with the same or number or approximately same number of similar modules M (example in FIG. 1B, FIG. 1G), which does not need necessarily to be exactly the same in form, shape, or dimensions. The number in the curved part in the example could be between 4 and 8, depending on the matching to the river shore and riverbed formation at the using site. The other side of the floating river has been not shown, as a skilled person can understand from the shown side of the floating river that the opposing side exists, following the shape of the shown part, in guiding the fish in the floating river.

However, in special cases natural formations of the natural river, the other side of the floating river can be formed by the natural shore formation in the water of the river, if applicable to provide the guidance accordingly by such embodiment of that kind of half-floating river provided by a floating river system of one side of the floating river modules in accordance with the example in FIG. 1.

According to an embodiment, the modules are shown as arcing, as such a form makes the guiding fences, i.e. the vertical walls 2 and the horizontal keels 1 of the modules forming a wholeness stiffer than just a merely straight wholeness of such floating river modules. This has also an effect to the inclining of individual module to keep it under better control. The buoys 3 can be form-changing, in accordance with the floating river in the flowing waters of the river. The buoys 3 has been illustrated according to an embodiment in FIG. 1 example in which the buoys 3 have a length approximately according to the module itself. However, according to an alternative embodiment the buoys' 3 lengths can be of any reasonable length of the floating river or parts thereof.

In the FIG. 1 the module M is illustrated as a module to form one side of the floating river. In the embodiment example, there are shown a horizontal keel 1 being connected or integrated to the vertical wall 2 as a part of the board of the floating river.

The vertical wall 2 part of the module M can be curved or straight to provide in the corresponding part of the floating river the desired form for the fish guidance.

The horizontal keel 1 can be used in the embodiments to provide a bottom fence to intensify the direction of the fish movement, and so to prevent the escape from the underneath of the vertical wall 2. So, the fish can be transported to the desired direction in the floating river, and/or to a collection point (cf. FIG. 3), such a funnel for example to lead them downstream of a dam, for example as illustrated in FIG. 4. According to an embodiment variant the floating river can be made in suitable part intact so that the fish can be compelled to follow the formation of the floating river. The species-specific fish instinct to swim in certain depth can be considered by the horizontal keel 1 location at the vertical wall 2 in water depth (h).

According to an embodiment the modules can be also attached in suitable part the back sides on each other (cf. FIG. 1B), to provide a suitable form, for example, when making branches in parallel or other formations of the floating river, in suitable part where applicable.

In the example of FIG. 1 the module M can comprise in an embodiment variant also connectors 5, 8, 10 that can be used to connect corresponding module M sides to other similar modules in the floating river system and/or in an ensemble of modules M. In FIG. 1, the reference numbers 5, 8, 10 are used to refer to the connecting edges of the module M, as well as to the corresponding respective connectors/gaskets. According to an embodiment variant the connectors 5, 8, 10 can be water penetrating as such, so to provide a communication passage to the waters in the river. Alternative of water tightness of the vertical wall 2 and horizontal keel 1, they can also be water penetrating for such alternative floating river (module) variants in which the waters are allowed to mix between the inboard and outboard waters of the floating river channel, but fish guidance without escape possibility under the vertical wall would be required. According to an embodiment variant the connectors can be provided in an embodiment variant to a part of the edge or edges of a module, but in a further embodiment the passage has been formed by the connectors so narrow that a selected sized fish of a certain species cannot go through, even if some small fish could do so.

Alternatively, the connectors 5, 8, 10 can be made watertight as gaskets (for example of rubber or other similar elastic material) in suitable parts to fit to the intended module edges to connect tightly. According to an embodiment variant some edges are meant to provide a communication passage for the waters between the floating river interior and the outside, external river, in which the floating river is intended to be floating. The interior is formed by bordering the channel as by defining the channel by the height h of the vertical walls 2 and/or width of the horizontal keels 1 in the embodied floating river system. The height h on dry land corresponds the depth h when in use in the water as floating.

As in FIG. 1 only a half part of a floating river has been exemplified, as forming and ensemble 100 of a floating river module that form a floating river system that has been exemplified. It is clear from the embodiment to a skilled person that the opposite side of the floating river part can be formed from similar modules M, in a pairwise manner (FIG. 1E), or alternatively by non-paired opposing wall forming ensemble of modules M, provided that the connections 5, 8, and 10 provide the channel structure for the floating river system so formed and so connected in an asymmetric way of confronting modules, if the natural formation of submerged parts of the river were not satisfactory been embodied for the fish guidance (i.e. for example steep formation of rock, etc.).

In the embodiment example of FIG. 1, the module is made floating by the buoys 3, one being shown at the vertical wall 2 and another buoy 3 further distantly, by supports 7, from the vertical wall 2, on water surface, but online above, or near or at edge of the horizontal keel 1 position. Buoys 3 can be attached by the buoy attaching means 3*b*, as exemplified in FIG. 1 by the ring-shaped accessories, but are not limited only to the shown way of attaching.

As illustrated in FIG. 1A, a skilled person can see from the embodiments, that the location of the buoys 3 can be mounted to alternatively selectable positions (alternative locations by the dashed lined circles) in respect of the shown number as well as the exact location, with the supports 7 in accordance with an embodiment alternative. The marking 2×M is indicative of two modules M being positioned together in the cross-section schematic in mirroring position being connected by a connector 10 as an example of a connectors to be used at the module edges to connect module edges to other modules. One top position buoy in FIG. 1A can be arced position, to provide resistance to wavy motion of the waters and its tendency to make shape formation, for example.

Some of the alternative embodiments in FIG. 1A has the supports 7 in the FIG. 1A cross section as drawn in a deflect direction from the water surface level w of the river (which can be the same level as in the floating river interior, but is not necessarily always the same, because of natural wind or waves for example). In such an embodiment the floating river can be used in an alternative manner (alternative to guide fish beneath the surface) to transport some articles that float at least partly on the surface. However, the deflecting supports 7 can be integrated together, although now being drawn as connected at one buoy 3 at the top. The supports 7 can be made in applicable part by pipes that are light-weight and strong as hollow structures, but they can also provide a spring element (by the supports 7) to the floating river to absorb various stochastic fluctuations in the river or floods etc. to follow elasticity by motto "bending but won't snap apart", especially in intensive swell of waves. According to this, the parts are sufficiently rigid to provide the form of the channel, but the materials also provide some elasticity and/or bending freedom to operate accordingly (as also illustrated in FIG. 1B, FIG. 1H).

As some of the buoys 3 are embodied to different levels on the vertical wall 2, this may be useful in some locations in the river bends to provide an inclination to better fit to the mounting site according to the river, as embodied by the modules M to embody the floating river also at the bendings. Higher vertical walls 2 (i.e. above the water level parts although extend to deepness h when in water) can be also embodied to persuade the fish not to jump over the vertical wall, when the buoys are nearer to the horizontal keel 1 as illustrated in FIG. 1A too. Although some buoys 3 in the FIG. 1A are drawn outboard position and attached in a submerged location to the vertical wall 2, a skilled person in the art knows immediately from the embodiments, that the outboard mount buoys can be used also at a distance from the vertical wall 2 on the water surface w.

In an insert A of the FIG. 1 there is also indicated an example of an embodiment to attach the modules M together at the vertical wall 2 edges by quick locks, embodied in the example by chains 4 for example and/or by a cable in the piping 6 that forms a chassis for the modules M for attaching the vertical wall 2. The chassis can have also vertical supports along the vertical wall 2. The buoys 3 can be attached at the buoys' ends to the floating river modules at the vertical wall edge as exemplified but can be connect by buoy connectors 3*b* also into other parts (i.e. supports) alternatively or in addition too. However, at the support 7 the connection location can serve for the maintenance, as the connection and the other parts of the module M in respect to the floating and connecting to the other modules at the surface can be so inspected at the same inspection. The cable can be used also to adjust the form of the composed floating river system by the cable length and/or tightness. Alternatively, the cable can be embodied by bar, which can be bending in suitable part to provide the form, in suitable part. Also combinations of bars and cables are possible to embody as such for the suitable part. Although arc form has been embodied in the example, the form can be even S-shaped and/or round, in suitable part, where applicable.

Also a collection fork (Cf. FIG. 4 ref. "Col") can be embodied by the floating river system formed by the floating river modules, as illustrated in FIG. 4, so to have two branches similar to the part 100 shown in FIG. 1, being mount so that the branches form a tapering surface area/water volume therebetween as a funnel towards the floating river opening end. When embodied by elastic material, the cable can provide such forms for the floating river that can vary according to the flow in the frame of the desired/adjustable response/resistance to the formation changes by the waters. The parts of the floating river can be anchored to the river bottom and/or shore formation in suitable part, by natural or artificial on-purpose made/tailored formations, which a skilled person in the art knows as such from the embodiments.

Such a cable can embodied at the water surface as illustrated in the FIG. 1 insert, but in addition and/or in alternative also as attached to the other parts of the vertical wall 2. According to an embodiment variant such a cable can be at the river side of the floating river, and/or at the inner side of the floating river.

According to an embodiment variant the fish guiding may need in certain flow conditions of the river to cover 5 the edges of vertical walls 2 of the immediately-each-other-succeeding floating river modules, but also in a similar manner, in some embodiments the edges of the horizontal keels 1.

In FIG. 1C this is embodied by using such cover having together integrated parts 5 and 10, respectively, which can according to an embodiment also be separate from each other in an alternative embodiment. In FIG. 1C also buoy 3 as well as the attachment 3*b* has been indicated. Similar form and shape objects are present as a skilled person recognizes such to similar form and shape objects (3, 3*b*).

According to an embodiment variant, at the edge seam, one or both respectively adjacent module parts of vertical wall 2 and horizontal keel 1 can be provided by an elastic/bending cover part (i.e. items 5 and 10 respectively) so to prevent especially the fish to leave the floating river at the seam, even if the seam were not water tightly embodied in a non-watertight seams embodiment.

FIG. 1B is illustrating similar module as in FIGS. 1 and 1A, for fish guiding fence module part that can move along the water in the river, but having an alternative connection mechanism by a plug 4*c* or screw 4*c*, to be put to the pivoting member pair 4*a*, 4*b* to form a hinge structure. According to an embodiment variant the plug 4*c* can be provided at the downside end by a perpendicular locking pin (to be attached to hole embodied in the plug 4*c* end, i.e. the locking pin as similar as an agricultural cotter) to make sure that the plug 4*c* would not fall by the waves in the river, for example.

The FIG. 1B illustrates also bending potential example, but the bending would not break the floating river as some examples on the movement amplitude of the modules in respect to each other with exemplary bending cones as in degrees 167 and 171, is illustrative, as being illustrated with no intention to limit the embodiments only to the shown example and values.

According to an embodiment, in FIG. 1D floating river modules M as an ensemble 100 has been illustrated with the buoy 3 attached to the vertical wall and connected by connector 7 to an additional buoy 3*a*, to stabilize the floating, as well as so preventing tilting in the flow of waters, so keeping the vertical wall 2 in its position to guide fish in a controlling manner to the desired direction. According to an embodiment variant the supports 7 for example can be used in attaching electronics in suitable part in the embodiments that use optical fish recognition means as illustrated further in FIG. 5.

Such an ensemble 100 of the modules as in FIG. 1D can be used in the formation of the collection fork Col as in the FIG. 4 example. For observing underwater fish, according to an embodiment the counter sensor optics is positioned underwater position at a specific module embodied. Other parts can be mounted overt the water surface and/or remotely, by using supports in suitable part.

FIG. 1E illustrates modules M (FIG. 1 for example) in a mirror geometry, in a closed bottom embodiment as at the front two opposing modules are illustrative.

In FIG. 2 there is embodied a part of a floating river system 200 comprising 10 modules M per two sides each at a straight part of the floating river channel, with an open bottom as such in the example. The modules at the sides are exemplified in a train position, i.e., one after the other. The channel has been indicated by the marking 2×10×M. The deepness can be down to the river bottom, or downwards over the deepness where the fish to be guided majorly swim according to their natural instinct. The buoys 3 are exemplified as in FIG. 1. In this example the modules M are pairwise mirror symmetrically put together to illustrate a floating river as a system composed of the floating river modules M to form a floating river in a desired length, with the depth h so that fish can be directed in the water accurately. The depth h is illustrating deepness direction from average local water surface level to the level where the vertical wall and horizontal keel meet each other. Some fish swim in certain depth, so it is not always necessary to boarder the bottom for such fish unnecessarily to provide the guidance effect, except where the fish are collected for exit from the floating river, if the exit location is in such position that the bottom is required to provide the guidance to the exit, for a lengthwise direction of certain number of the floating river modules of the floating river.

The bottom can be used in certain parts of the floating river as illustrated in FIG. 3, to enhance the guidance of the fish.

In FIG. 3 there is embodied examples on details of a floating river system variant 200. At the end at the upper right the floating river system 200 has a tapering part formation provided by specially formed modules of M' to provide the tapering to guide the fish to the funnel Fu, by a guiding formation made of a net, to further guide the fish into a desired location, in this case, towards the funnel entrance opening end and the continuing channel therefrom downstream in the example. Such location could be at a dam upstream site (cf. FIG. 4), at an entrance to a siphon (cf. FIG. 4 Sip) as such, or, to a migratory fish passage unit variant being used to provide such a similar passage for fish for an entrance to pass the dam and so in avoidance of turbine tunnels on their way to downstream direction of the river.

The tapering part (2×2×M') also shows a further embodiment of the buoys 3' attaching to the vertical wall. The buoys 3' can be embodied in a similar way as the buoys 3, but adapted to the tapering form of the floating river. The marking 2×2×M' is indicative that the tapering is provided by the specially formed modules M', in the example embodied as pairwise by two such pairs in the illustration, without intention to limit the number or the tapering only to the shown example with the detailed composition and symmetry in a mirror wise manner. The tapering can be implemented by the hinge formations with specific bending angles and the connectors to connect the vertical walls at the tapering beginning part.

In the example the floating river system part 200 has in some part a bottom Bo, provided with such horizontal keels 1 and connectors 10 as embodied in FIG. 1, the modules M and M' being connected to form the bottom Bo for enhancing the guidance to the funnel and the discharge at the funnel formation end for the further routing of the fish. The connection of M' to other modules M and/or M' can be embodied as illustrated in FIG. 1, as a skilled person knows as based on the embodiments shown. The horizontal keels can be embodied accordingly to the specified tapering with the specified connectors to connect other parts of the floating river according to the placement.

FIG. 4 illustrates an embodied example of the floating river system 200. The system 200 comprises in the example a collection fork Col to be used in the guidance of the fish from the upstream pool parts to the floating river system's 200 fork Col. The reference sign Col has been marked to one branch although there is shown two in the example, as a skilled person in the art knows immediately that the other branch is similar in the structure and has a composition of the modules M as the collection fork part marked by Col. As illustrated in FIG. 3, the floating river system 200 comprises in the example a funnel Fu at the dam (Dam) side of the floating river system 200 leading to a tube or pipe operating as a siphon (Sip) or similar water passage from the upstream pool to downstream from the dam (Dam), so leading water and the fish swimming it through under or pass the dam, to the downstream waters at the lower level in elevation.

With reference to FIG. 7, in an alternative embodiment variant to collect and guide fish to the floating river, there can be used branches (Col, 100) in such branching embodiment that may lead the fish from the branches as collected to the floating river channel 200.

According to an embodiment variant illustrated in FIG. 5 the fish swimming in the floating river can be counted and sized as well as the species recognized by an embodied specific module MC, which is a similar module as in FIG. 1 and FIG. 1A in the mechanical parts to float and fence, which module MC however comprises the fish observation means L, Ld and/or camera. The fish observation means are also considered as counter.

The observation means L at the righthand side MC at the right is embodied as LIDAR, i.e. as an optical radar based on Laser light emission. Alternatively or in addition, such a specific module MC can have a camera (or an ensemble of cameras) connected to a photogrammetric system with the photogrammetric processor Pr to measure and classify the fish in the floating river cross section at the module MC. The photogrammetric processor Pr can have a microprocessor as well as memory, of volatile and/or permanent type(s) so that the program algorithm being used in recognition providing the results, the results as well as operating parameters and data can be saved and restored for the further processing as well as for transmitting via the connected transceiver unit 3*i*. However, the processor Pr need not to be in the water or at the module MC as such, but a functional communication is required for data transfer in such an embodiment. The transceiver unit in the example is connected to a buoy or a support supporting the buoy, as well as the antenna Ant for wireless communication, for communication to a remote site.

In the drawing, it is schematically illustrated that the buoy 3*i* has as integrated or attached transceiver to the buoy, which has an ordinary buoy part, but has also an antenna Ant to provide communication connection between a remote station and the transceiver at the module, so to communicate the fish related data from the L, Ld and/or Pr to information networks, as exemplified by the Internet (To internet). The connection can use in addition or alternative cellular and/or wi-fi in combination in suitable part. Also Internet of Things (IOT) can be used where applicable. However, the connection can be alternatively embodied by a cable, in suitable part. At the left in FIG. 5, the box Ld is illustrating also such an embodied alternative LIDAR unit Ld which has a permanent memory (i.e. a memory card) to be replaced and/or read arbitrary at the maintenance to get the information.

Although the LIDAR units L and Ld are drawn as they were submerged as well as the photogrammetric processor Pr with the peripherals therein, it is not necessary to have all the named parts sub-merged, but they can be located alternatively above the water surface w, in suitable parts.

FIG. 6A and FIG. 6B illustrate a floating river system 200 as in demonstration conditions as embodied as a straight floating river system part (left, FIG. 6A) and in a curved (right, FIG. 6B) embodiment. The system is floating and can be positioned to certain position and/or form by weights in the river bottom, and/or cables/bars, etc. attaching to land and/or suitable structures available at the river, naturally and/or artificially made, in suitable part. The form can be controlled by controlling the attaching, as well as the cable tightness and/or the flow conditions directed to the floating river part.

FIG. 7 is illustrative such an embodiment variant according to which the floating river 200 composed of floating river modules M (and/or special floating river modules M' and/or MC), has an ensemble of branching structures, the branches 100 having an embodied floating river system 100 composition of the floating river modules just mentioned. The reference numeral Col is referring to the collection, of the fish, being guided to the floating river 200 main channel.

EXAMPLES

While in the following some exemplary embodiments are illustrated in suitable part by conditional language, such as, among others, "can," "could," "might," or "may," unless specifically stated otherwise, or otherwise understood within the context as used, is generally intended to convey that certain implementations could include, while other implementations do not include, certain features, elements, and/or operations.

Example 1. An embodied floating river module (M), (M'), (MC) according to the present disclosure has been manufactured so that the module has at least one buoy (3), (3'), (3*i*) to float the other parts (1), (2) of the module (M), (M') (MC), such as vertical wall element (2) and at least one horizontal keel element (1). The vertical wall element (2) has the buoy attachment so that the vertical wall element (2) is at least partly submerged when in duty in water. As the vertical wall element and horizontal keel element float because of the buoy(s), the buoys (3), (3'), (3*i*), are preferably solidly attached to the vertical wall element (2).

According to an embodiment, the vertical wall element (2) can comprise the horizontal keel element (1) as an integrated part made of the same body. However, according to an embodiment variant, the horizontal keel element can be attached to the vertical wall element by welding or by quick lock mounting to lock to the position in horizontal plane, as the horizontal keel element operates as stabilizer to keep the vertical wall element in vertical position. However, in rough circumstances, especially in stormy conditions to produce waves on water surface, the reciprocating movement of buoys and wind loadings can also have a force on the horizontal keel element via the vertical wall element, and a consequential torque to the attachment point to the vertical wall element. According to an embodiment variant the horizontal keel element is made replaceable to provide maintenance also in such waters, although a single module loading may be divided between the neighboring modules to the floating river structure.

According to an embodiment, the floating river module (M), (M') (MC) can have two distinguished buoys (3), (3'), (3*i*) to float the other horizontal parts (1), and vertical parts (2) of said module (M), (M'), (MC). Although vertical wall element has attached to a buoy in one embodiment at the upper edge of the vertical wall element, another buoy can be attached by support (7) to an inboard position of the formed floating river, so facilitating stable floating of the vertical wall element in vertical position. According to a further variant there could be provided alternatively or in addition a buoy (3), (3'), (3*i*) to an outboard position to even further to stabilize the vertical wall element position to vertical direction, in co-operation with the horizontal keel element of an embodied floating river module (M), (M'), (MC).

Example 2. According to an embodiment of the floating river module (M), (M'), (MC) of the present disclosure, in accordance with the Example 1, can comprise such a vertical wall element (2) which comprises an edge formation (5) to attach to another similar module (M), (M'), (MC) in a train position. The attaching can be provided by an edge formation to straight edge to edge attaching between two neighboring modules, or by an intermediate connecting member (5) between the successive neighboring modules (M), (M') (MC). The modules (MC) and (M') are special kind of modules with some modifications with further features as discussed earlier, however being compatible with the other modules (M) for use in an appropriate manner where applicable for the wholeness. Accordingly the attachment to the other modules to form a floating river system can be made accordingly also for the special modules (M'), (MC) as part of such a system.

Example 3. According to an embodiment of the floating river module (M), (M'), (MC) in accordance of the examples Example 1 and/or Example 2 the horizontal keel element (1) can comprise such an edge formation (8) that enables attaching straight edge to edge of the parts attaching between two neighboring modules, or by an intermediate connecting member (8) between the successive neighboring modules (M), (M') (MC), for a train position, at the horizontal keel elements, too.

In some parts of the floating river, fish may need a further enhanced guiding, which can be implemented by a bottom, especially at the inlet/exit locations, such as ports and/or funnel formations tapering towards such, so that the fish know where to go, but do not get under the vertical wall, which would be the case if there was an open bottom. The floating river modules (M), (M') (MC) in a mirroring position, i.e. in an opposing position the horizontal keel elements (1) can comprise each an edge formation (10) to attach to another similar module (M), (M') (MC) in a mirroring position, alternatively straight via an edge formations a module (M), (M') to the mirroring module (M), (M') or by an intermediate connecting member (10) between the two mirroring modules (M), (M'), also in the horizontal keel elements, to form the bottom, where estimated to be required for the floating river.

Example 4. In accordance with the examples 1, 2 and/or 3, an embodied module (M), (M'), (MC) does not need to be necessarily watertight, although fish proofness, especially for those species that are intended to be guided would be advantageous.

Consequently the vertical wall element (2) and/or said horizontal keel element (1), can comprise a formation for a water passage through the plane and/or at the edge and connecting members. In other words, the vertical wall element (2) and/or said horizontal keel element (1), can be so in water communication between the waters in which the floating river floats and the waters in the floating river channel volume that said module (M), (M')) and/or an ensemble (100), (200) of said modules (M) define with the water surface (w).

As apparent from the examples shown, the floating river module (M), (M'), (MC) forms a half of a cross-section of said floating river channel cross section.

Example 5. In accordance with the previous examples, the floating river module (M), (M'), (MC) can have such a vertical wall element (2) that is curved in form in the direction of the river flow channel. This is for providing by such embodiment flow resistance to floating river system by the module portions, that opposes the forces that tend to pivot the vertical wall element to nonvertical position, towards horizontal positions.

Example 6. A floating river system (100), (200) to provide the floating river channel and the walls (100) of such, and/or guiding formations (Col, 100), the floating river system (100), (200), (Col), comprises an ensemble of floating river modules (M), (M'), (MC), of the floating river system. These floating river modules can be the floating river modules according to anyone of the previous examples (including the Examples 1 to 5) in applicable part.

According, the floating river system (200) as a floating river, having its main channel is formed as a sub-merged flow channel, being fenced by vertical wall elements (2), into the water in which the floating river modules (M), (M'), (MC) float, the floating river modules can be connected by quick-lock parts (4), (4*a*), (4*b*), (4*c*) to quick-lock to each other at vertical wall elements (2) for obtaining the channel wall for the floating river.

Curved form to the wall of the floating river channel can be obtained by the floating river module system using floating river modules (M), (M'), (MC), that have the module connections in the vertical wall element (2) to connect the modules to a stepwise curved form with certain curvature in the direction of the river flow channel, i.e. even by straight vertical wall elements (2) curved form can be obtained, so to have the resistance for pivoting flows by such step-wise provided arcing form with such modules with straight vertical elements. However, the curvature as such is not limited, but depend on the water pool or passage in which the floating river is intended to float, as well as on the guidance of the fish from one location to another and the need of collect fish to the floating river main channel (200) (cf. for example FIG. 7).

Example 7. A floating river system according to anyone of the previously shown examples 1 to 6, such an embodied system can have counting means (L), (Ld), (Camera), (Pr) to count, estimate the size and/or recognize the fish in the floating river formed by the floating river system (100), (200). Such counting means can be situated at a floating river module of the system, however branches and collecting points at the entrances as well as exit locations from the floating river channel can be provided with the counting means, so that fish can be detected, and the species-specific statistical information obtained from the fish swimming in the floating river.

In applicable parts, the system can have a light source to provide light for the counting means, in suitable parts. The light source can be used also for guiding/attracting the fish that like the light. However, such a light source can be excluded from such floating river or parts thereof that are used in guidance of fish that avoid light.

According to an embodiment variant of the system exemplified the counting means are optical counting means to map the fish at an observation volume of the counting means in the system. The counting means can comprise an underwater LIDAR (L), (Ld), camera (Camera) and/or photogrammeter (Pr).

Example 8. The floating river system according to anyone of the previous examples can comprise such a floating river module, which has a fish identification system sensor to identify the fish passing by in the floating river, as identification system based on RFID-reader to read tags of a fish that has been tagged, sending a challenge, and reading the response signal, at the distance of the RFID-reader operation range. According to an embodiment variant, one or some of the floating river modules of the floating river (200), which is also a floating river system (100, 200), has a radio telemetry system antenna to identify fish as based on suitable tag, when such a fish passes by the radio telemetry. According to an embodiment variant the module is such a module that has as the radio telemetry reader that can read a PIT TAG-tags (Passive Integrated Transponder tag) and so identify the fish carrying such tags with the information in such an implantable tag.

Such a floating river module can be situated at the exit module, for example, which has a radio telemetry system antenna, connected to transmitter/receiver to read tags attached to fish that has been tagged, such as PIT TAG, by the cast radio telemetry system's challenge and to identify the tag and so the tag carrying fish by the received response.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation The skilled persons will again appreciate the fact that the explicitly disclosed embodiments were constructed for illustrative purposes only, and the scope will cover further embodiments, embodiment combinations and equivalents that better suit each particular use case of the present disclosure of the invention.

The invention claimed is:

1. A set of floating river modules, each floating river module of the set of floating river modules comprising:

a vertical wall element, the vertical wall element having a top edge extending in a length direction and having side edges extending in a depth direction, the vertical wall being partly sub-merged;

a horizontal keel element having a first edge and an opposite second edge extending along a length of the horizontal keel element, the first edge of the horizontal keel element being attached to the vertical wall element, the horizontal keel element being sub-merged; and a first buoy solidly attached to the top edge and extending along the length direction of the vertical wall so as to float the vertical wall element, wherein each floating river module of the set of floating river modules is connected one to another, wherein the vertical wall element of each floating river module of the set of floating river modules forms a side wall of a floating river and the horizontal keel element of each of the set of floating river modules forms a bottom side of the floating river, wherein said vertical wall element of each floating river module of the set of floating river modules comprises a vertically extending edge formation that attaches the vertical wall element of a first of said floating river modules, in a train position, to the vertical wall element of an adjacent one floating river module of the set of floating river modules, wherein said horizontal keel element of each floating river module of the set of floating river modules comprises a horizontally extending edge formation that attaches the horizontal keel element of the first of said floating river modules, in the train position, to the horizontal keel element of the adjacent one of said floating river modules of the set of floating river modules, wherein the vertical wall elements of the set of floating river modules together with the vertically extending edge formations form the side wall of the floating river, and wherein the horizontal keel elements of the set of floating river modules together with the horizontally extending edge formations form the bottom side of the floating river.

2. The set of floating river modules according to claim 1, further comprising a second buoy solidly attached to the vertical wall element of each floating river module of the set of floating river modules, the first buoy being spaced apart from the second buoy.

3. The set of floating river modules according to claim 1, wherein the second edge of the horizontal keel element of each floating river module of the set of floating river modules comprises a lengthwise edge formation that attaches to the second edge of another floating river module positioned in a mirroring position such that groups of two of the floating river modules are connected in the mirroring position opposite each other.

4. The set of floating river modules according to claim 1, wherein a first group of adjacently attached, in the train position, of said floating river modules are positioned opposite and in a mirroring position to a second group of adjacently attached, in the train position, of said floating river modules defines a formation defining a floating river channel with a water volume that provides for a water passage through said vertical wall elements and said horizontal keel elements of first and second groups of said floating river modules positioned in the mirroring position.

5. The set of floating river modules according to claim 4, wherein each said floating river module is a half-cross-sectional element of said floating river channel.

6. The set of floating river modules according to claim 4, wherein said floating river modules are adjacently arranged such that said adjacently connected vertical wall elements define a curved form in a direction of water flow in the floating river channel.

7. The set of floating river modules according to claim 1, wherein the vertical wall element of each of the floating river modules further comprises quick-lock parts that quick-lock adjacent ones of the floating river modules to each other.

8. The set of floating river modules according to claim 1, wherein said floating river modules are arranged as a floating river system.

9. The set of floating river modules according to claim 8, wherein the floating river modules are mutually connected so as to form a sub-merged flow channel being fenced by the vertical wall elements of the mutually connected floating river modules, into the water in which the floating river modules float.

10. The set of floating river modules according to claim 8, wherein the buoy and/or said sub-merged vertical wall element of each of the floating river modules comprises quick-lock parts that quick-lock to the vertical wall elements and/or buoys of other ones of the floating river modules.

11. The set of floating river modules according to claim 8, wherein the vertical wall elements of each of the floating river modules are connected to each other to connect the floating river modules to define a curved form with curvature in a direction of water flow in a floating river channel defined by the floating river system.

12. The set of floating river modules according to claim 8, further comprising cameras arranged to count fish, estimate fish size and/or recognize the fish in the floating river formed by the floating river system.

13. The set of floating river modules according to claim 8, further comprising an optical sensor to map fish at an observation volume of the floating river system.

14. The set of floating river modules according to claim 8, wherein one floating river module has a radio telemetry system antenna, connected to transmitter/receiver to read tags attached to fish that has been tagged by a cast radio telemetry system's challenge and to identify the tag by the received response.

15. The set of floating river modules according to claim 1, further comprising at least one of a LIDAR camera and photogrammeter arranged for data acquisition.

* * * * *